US006148898A

United States Patent [19]

Sjodahl et al.

[11] Patent Number: 6,148,898

[45] Date of Patent: Nov. 21, 2000

[54] POURING METHOD AND PLANT THEREFOR

[75] Inventors: Eric Sjodahl, Alingsås; Sören Nilsson, Göteborg, both of Sweden

[73] Assignee: Selcom AB, Partille, Sweden

[21] Appl. No.: 09/077,550

[22] PCT Filed: Nov. 26, 1996

[86] PCT No.: PCT/SE96/01540

§ 371 Date: Jun. 1, 1998

§ 102(e) Date: Jun. 1, 1998

[87] PCT Pub. No.: WO97/20651

PCT Pub. Date: Jun. 12, 1997

[30] Foreign Application Priority Data

Jan. 12, 1995 [SE] Sweden ..... 9504314

[51] Int. Cl.[7] ..... B22C 9/00; B22D 46/00; B22D 33/04

[52] U.S. Cl. ..... 164/24; 164/457; 164/155.4; 164/137

[58] Field of Search ..... 164/24, 322, 323, 164/324, 4.1, 150.1, 151.2, 137, 339, 456, 457, 155.4, 154.2

[56] References Cited

U.S. PATENT DOCUMENTS 4,724,886 2/1988 Sjodahl ..... 164/4.1
4,724,894 2/1988 Sjodahl ..... 164/457
5,101,880 4/1992 Fujiwara et al. ..... 164/154

FOREIGN PATENT DOCUMENTS 42 02 020 7/1993 Germany .
91/14525 10/1991 WIPO .

*Primary Examiner*—Harold Pyon
*Assistant Examiner*—I.-H. Lin
*Attorney, Agent, or Firm*—Jacobson, Price, Holman & Stern, PLLC

[57] ABSTRACT

A pouring method and a pouring plant are described. Mould sections (15) are produced piecewise with cavities at two opposite ends thereof. The mold sections are combined in a line (15A–15D), wherein the cavities define a mold cavity (15*a*) having an exposed pour cup (30). The line of mold sections is advanced incrementally by drive means (16, 162) through an increment length that corresponds to the length of the mold sections (15), to and through a molding station (50). The true lengths of the produced sections (15) are measured and registered. The difference in length between the first mold section (15D) in the line (15A–15D) that lies immediately upstream of a pour cup (30), where a pouring operation was last carried out, and the last mold section (15A) in the line is calculated. The pouring machine (20) is moved from its latest pouring position along the line through a distance corresponding to this length difference while the line (15A–15D) is advanced towards the pouring station (50) to an end position (18) of the line advancing means (16, 162).

4 Claims, 2 Drawing Sheets

POURING METHOD AND PLANT THEREFOR

CROSS-REFERENCE TO RELATED APPLICATION

This application is a 371 of PCT/SE96/01540, filed on Nov. 26, 1996.

BACKGROUND OF THE INVENTION

1. Field of the Invention

The present invention relates to a pouring method and a pouring plant of the kind in which mold sections are fabricated, each having a cavity at two opposite ends, the mold sections forming a series or line of mold sections such that said mold sections are in mutual contact at said ends, whereby the mold sections define in respective contact regions mold cavities that have an exposed pour cup. A last fabricated mold section is advanced into contact with the line of preceding mold sections and continues to be advanced, with the line of preceding mold sections, through a distance that corresponds to the length of a mold section. The line of mold sections is led through a pouring station that includes a pouring machine that can be moved in the direction of the line. The position of the pouring machine is corrected in the longitudinal direction of the line so as to align the machine with the position of the pour cup subsequent to moving the line of mold sections, during which movement the upstream end of the last mold section in the line is moved to a predetermined position. A plant for producing such molds includes a machine for fabricating mold sections, means for producing the line or series of mold sections, drive means operable to advance the last fabricated mold section into contact with the line of preceding mold sections and to continue to advance the line of mold sections, a pouring station with pouring machine, and means for correcting the position of the pouring machine so as to align the pouring machine with the position of the pour cup in the pouring station.

2. Description of the Related Art

A pouring technique of the kind to which the invention pertains is disclosed, for instance, in U.S. Pat. No. 4,724,894. According to U.S. Pat. No. 4,724,894, parallelepipedic mold sections are fabricated from mold sand. Cavities are therewith formed at the front and the rear ends of the mold sections. The mold sections are combined to form a series or line, wherein a poured mold is formed between each pair of mutually adjacent mold sections in said series or line. There is also established a pour cup which receives the molten metal to be cast in the mold. The line of mold sections is advanced incrementally by means of a ram that has a predetermined end position. The line of mold sections extends through a pouring station which includes a pouring machine. The pouring machine is movable in the longitudinal direction of the line of mold sections. A non-contact sensor, for instance, in the pouring station senses whether or not the pour cup is positioned properly in relation to the pouring machine when the line advancing ram is located in its forward end position. If alignment is incorrect, the pouring machine is moved to a correct position in relation to the pour cup prior to commencing pouring. In order to shorten the pouring cycle, the sensing means is operable for sensing the edge of the pour cup during forward driving movement of the ram. When the cup edge is sensed, the remainder of the distance to be moved by the ram is evaluated and the anticipated position of the next pour cup to arrive at the pouring station is calculated on the basis thereof. The pouring machine can be moved to a proper position relative to the anticipated final position of the new pour cup/mold on the basis of this information. When the new cup is located in its definite position in the pouring station (when the ram has reached its forward end position), the sensing means is operable for ascertaining the actual position of the cup. The sensing means is also preferably used to sense and control the level of molten metal in the pour cup.

It is known that mold sand has a varying compressibility and that the lengths of the mold sections are dependent thereon. Naturally, the length of the mold sections can also vary between mutually sequential mold sections.

SUMMARY OF THE INVENTION

The object of the present invention is to provide a method and plant which takes the varying lengths of the mold sections into account and which enables the pouring machine to be pre-positioned correctly on the basis hereof.

This object is achieved with the method in which mold sections are fabricated, each having a cavity at two opposite ends, the mold sections forming a series or line of mold sections such that said mold sections are in mutual contact at said ends, whereby the mold sections define in respective contact regions mold cavities that have an exposed pour cup. A last fabricated mold section is advanced into contact with the line of preceding mold sections and continues to be advanced, with the line of preceding mold sections, through a distance that corresponds to the length of a mold section. The line of mold sections is led through a pouring station that includes a pouring machine that can be moved in the direction of the line. The position of the pouring machine is corrected in the longitudinal direction of the line so as to align the machine with the position of the pour cup subsequent to moving the line of mold sections, during which movement the upstream end of the last mold section in the line is moved to a predetermined position. The length of the fabricated mold sections is measured, and the length difference between the first mold section in the line that lies immediately upstream of the pour cup in the pouring station, subsequent to moving the line, and the last mold section in the line is calculated. The pouring machine is moved from its previous pouring position through a distance that corresponds to the length difference so that the pouring machine is placed in alignment with the anticipated final position of the pour cup on the next mold to be advanced into the station. The object is also achieved with a plant that includes a machine for fabricating mold sections that each have a cavity at opposite ends thereof; means for producing a line or series of mold sections such that said mold sections are in mutual contact at said ends, whereby the mold sections define in respective contact regions mold cavities that have an exposed pour cup; drive means operable to advance the latest fabricated mold section into contact with the line of preceding mold sections and to continue to advance the latest fabricated mold section and the preceding mold sections through a distance that corresponds to the length of the latest fabricated mold section, wherein the drive means lead the line of mold sections through a pouring station that includes a pouring machine that can be moved in the direction of the line; and means for correcting the position of the pouring machine so as to align the machine with the position of the pour cup in the station subsequent to moving the line of mold sections, wherein the means for advancing the line of mold sections have a predetermined end position; means for measuring the length of the fabricated mold sections; calculating means for calculating the length difference between the first mold section in the line, the first mold section lying immediately upstream of the pour cup in the pouring station, and the last mold section in the line; and means for moving the pouring machine from its previous pouring position through a difference that corresponds to the length difference so as to place the pouring machine in alignment with the anticipated final position of the pour cup on the next mold advanced into the station by the drive means.

Embodiments of the invention include preparing the pouring machine for a pouring operation while the pouring machine is moving towards an anticipated pouring position, and commencing the pouring operation immediately prior to the pour cup reaching its final position. The method may also include the steps of sensing the actual final position of the pour cup in the pouring station and finely adjusting the position of the pouring machine in relation to the pour cup when necessary. The plant may include moving means adapted to drive the pouring machine to the calculated final position of the next pour cup as the pour cup moves towards the final position, and may also include means for commencing a pouring operation immediately prior to the pour cup reaching its final position. The plant may also include means for sensing the level of molten metal in the pour cup in the pouring station, preferably in a contactless manner; the sensing means may be further adapted to sense the position of the pour cup in relation to the pouring machine. The pouring machine may also be adjustable in dependence on the position of the pour cup as sensed by the sensing means.

Essential features of the invention involve measuring the length of the fabricated mold sections or units and calculating the difference between the first mold section of the mold section series or line that lies upstream of the pouring station and the last mold section in said series or line, i.e. the mold section that lies nearest in front of the mold advancing ram, and moving the pouring machine from its previous pouring position through a distance corresponding to this difference in length, so that the pouring machine will be placed in alignment with the anticipated position of the pour cup on the next mold to be advanced into the pouring station.

Thus, the invention enables the necessary movement of the pouring machine along the line of mold sections to be calculated at a very early stage, i.e. already in conjunction with advancing a newly fabricated mold section into abutment with the preceding mold sections in said line and therewith provide ample time for moving the pouring machine to the calculated pouring position so that it can readily be ensured that the pouring machine will have taken the intended position prior to the pour cup of the new mold section having reached the end position in the pouring station.

Furthermore, because the final position of the pour cup has been calculated with great precision, the pouring machine can be activated to commence a pouring operation immediately prior to the pour cup having reached its final position. This enables an increase of 10% in the production rate to be achieved. Naturally, it can be checked that the pour cup is actually located in said anticipated position with the aid of the sensing means, although it will not normally be necessary to correct the position of the pouring machine along the line of mold sections.

It is, of course, possible to sense the instantaneous position of the new pour cup moving into the pouring station with the aid of the sensing means, and to determine at this moment in time the residual length of stroke of the mold advancing ram, so as to obtain a check indication of the end position of the pour cup in the pouring station.

BRIEF DESCRIPTION OF THE DRAWINGS

The invention will now be described in more detail with reference to preferred embodiments and also with reference to the accompanying drawings, in which.

DETAILED DESCRIPTION OF THE PREFERRED EMBODIMENTS

Figure 1:
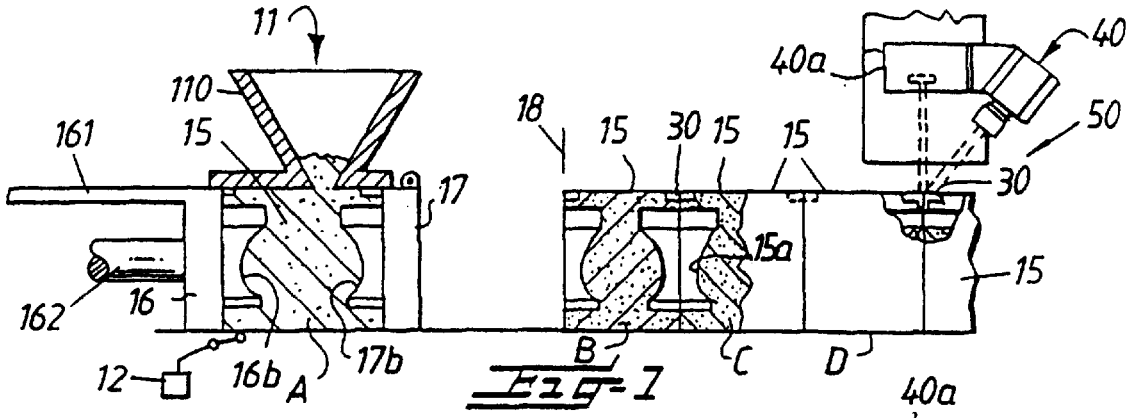
FIG. 1 is a schematic partial longitudinal view of part of an inventive plant.

Seen in FIG. 1 is a machine 11 for fabricating mold sections 15. The machine 11 includes a tunnel having a front end wall 17 which includes a mold die 17*b*. A ram 16 can be driven into the rear end of the tunnel. The ram 16 comprises a wall that carries a mold die 16*b*. The ram 16 also carries a rear-wardly extending upper shielding means 161 which functions to shield-off the sand dispensing opening of the machine as the ram 16 advances through the tunnel. The ram 16 is connected to a piston rod 162 of a reciprocatingly movable drive means (not shown), which is operable for moving the die plate 16 to a forward end position 18 corresponding to FIG. 4 and to a rearward end position corresponding to FIG. 1.

Figure 2:
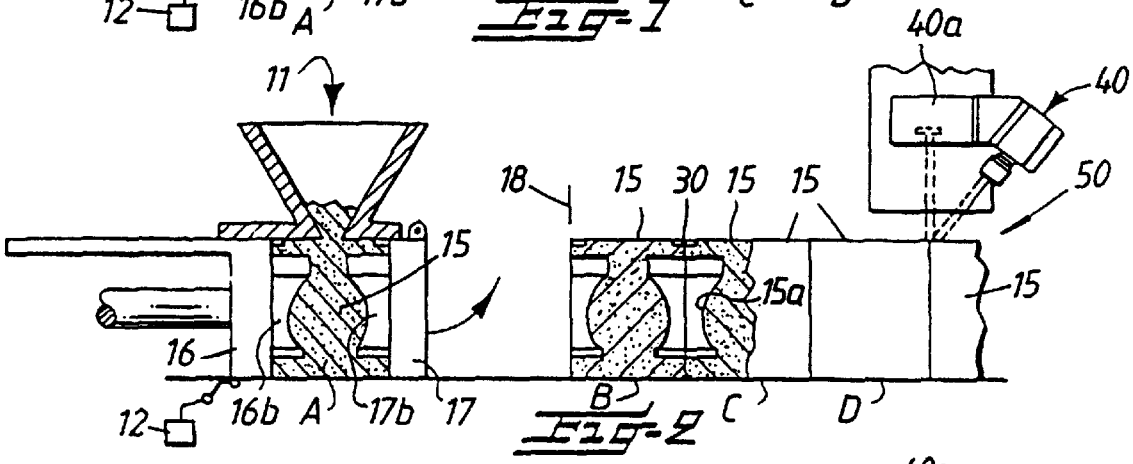
FIGS. 2–4 are partial longitudinal sectional views corresponding to FIG. 1, but illustrating different parts of a working cycle.

Sand is delivered to the mold chamber defined by the tunnel and the walls 16, 17, whereafter the ram wall 16 is driven towards the wall 17 as illustrated in FIG. 2, thereby forming a mold section 15 that has cavities at opposite ends. As evident from FIG. 2, the wall 17 carrying the die 17*b* can then be moved out of the way, so as to enable the mold section 15A to be pushed forwards by the ram 16 into contact with the preceding mold section 15B previously fabricated by the machine 11 and advanced by means of the ram to the end position thereof. Thus, the ram 16 is operable for pushing the line or series of mutually adjacent mold sections 15B–15D through a distance that corresponds to the length of the newly fabricated mold section 15A, wherein the upstream end of the mold section 15A will lie in the position 18 corresponding to the downstream end position of the ram 16. Adjoining mold sections 15A, 15B and 15B, 15C and so on will therewith form pouring molds having mold cavities 15*a* that are formed by the cavities in the contacting regions of respective mold sections and that each have an exposed pour cup 30.

A pouring station 50 includes a pouring machine 20 that is adjustable to the right and to the left in FIGS. 1–4, and means 40, 40*a* for sensing, preferably non-contact sensing (e.g. optically, with laser, etc.), which is directed towards the pour cup 30 in the mold that has been driven into the station 50. The sensing means 40, 40*a* functions to sense the level of molten metal in the pour cup 30 during a pouring operation, and is co-operative in controlling the flow of metal by controlling a piston-cylinder device 21*c* (FIG. 5) belonging to the pouring machine, said device moving the end 21*a* of a stopper 21*b* into or out of engagement with a seating 21 in a ladle 19, in a conventional manner. The illustrated sensing means, or some other alternative sensing means (not shown), can be used for non-contact detection, or some other form of detection, of the arrival of the pour cup 30 at the pouring station 50 or detects its actual position in said pouring station, and is used to finely adjust the position of the pouring machine in relation to the pour cup.

Figure 3:
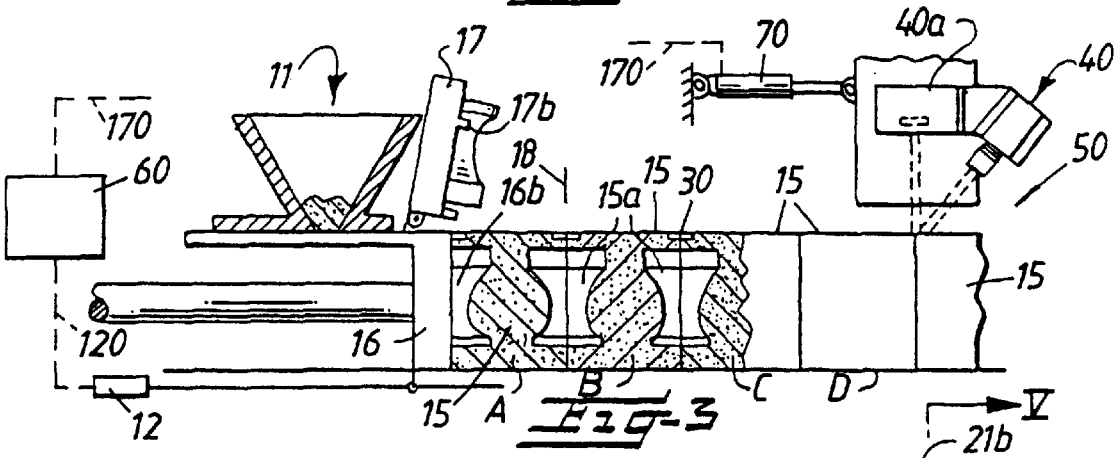
Figure 4:
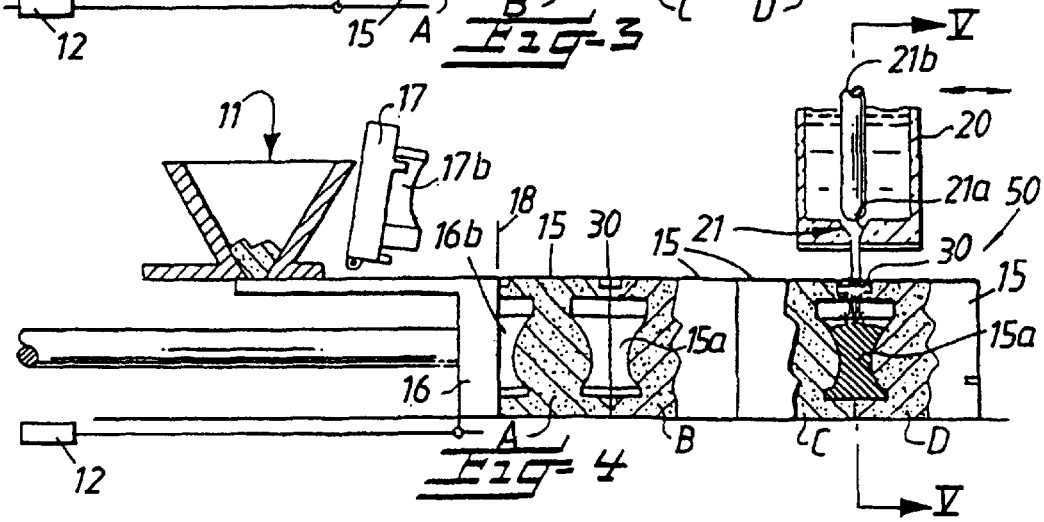
Figure 5:
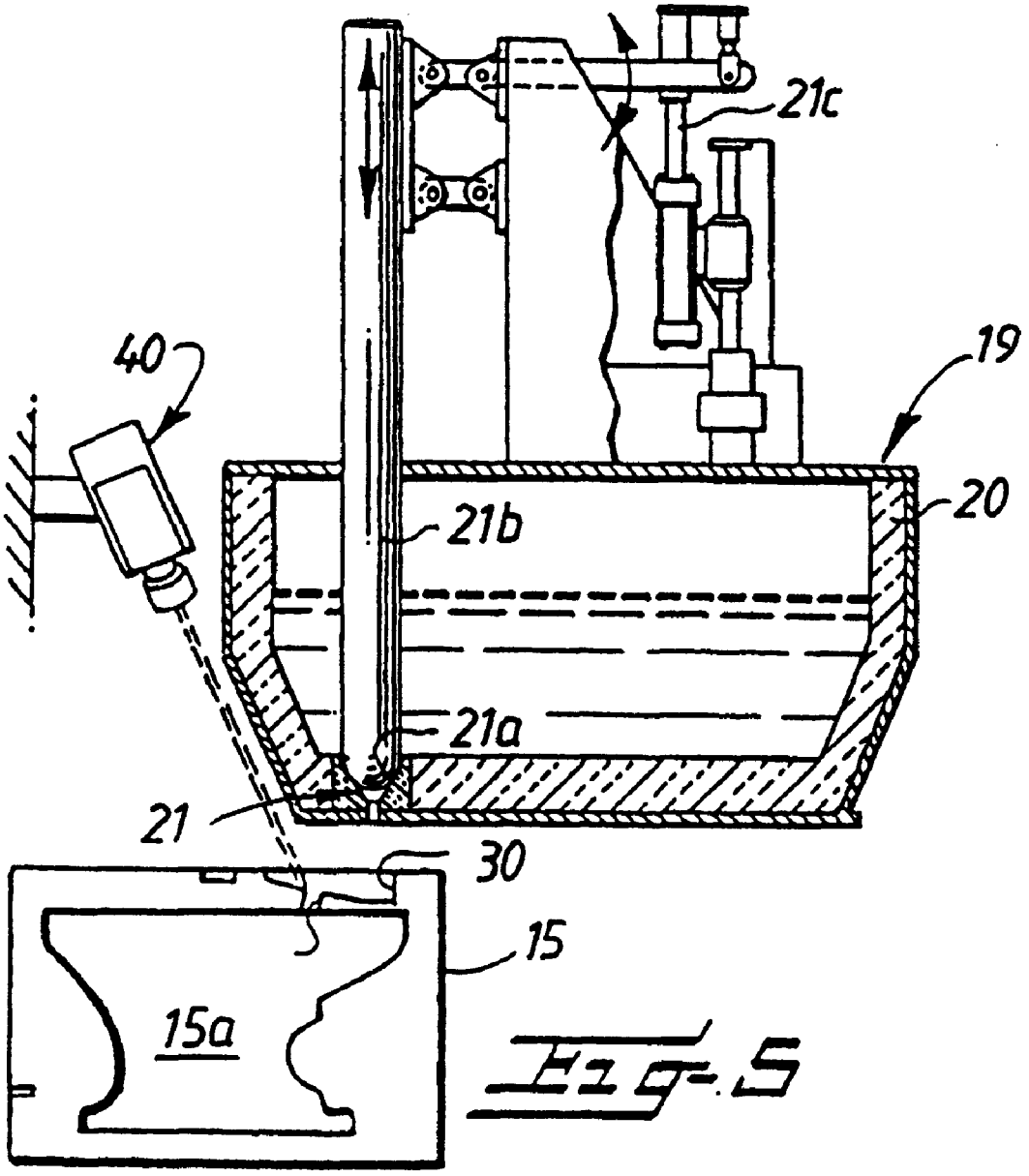
FIG. 5 is a sectional view taken on the line V—V in FIG. 4.

Co-ordinated with the machine 11 is a device 12 for measuring the actual length of the mold sections 15 fabricated in said machine. The measuring device 12 may, for instance, function to sense the ram wall 16 in FIG. 2 and to provide a measurement of the length of the mold section 15A as the mutual distance between the walls 16 and 17. The measured lengths of respective mold sections 15A–15D are registered in a calculator/computer, indicated at 60 in FIG. 3, which compiles the difference between the first section 15A of the section series and the last section 15D in said series (i.e. the nearest mold section to the pouring machine 50 upstream thereof). Alternatively, as indicated in FIGS. 3 and 4, the measuring device 12, shown connected to the calculating means 60 via the conductor 120 shown in a broken line, may be adapted to measure the actual length of respective mold sections 15, by sensing the position of the ram wall 16 after it has moved a mold section, such as the mold section 15A in FIG. 3, into contact with the preceding series of mold sections, and after it has reached its forward end position 18.

The length differences between the sections 15A and 15D defines the distance through which the pouring machine 20 must be moved in one direction or the other in order to be moved from its previous pouring position and placed in a proper position relative to the pour cup 30 on the next mold 15C, 15D to be advanced into the station 50. A device 70 for effecting such pouring machine movement is indicated in FIG. 3 and is controlled from the calculating means 60 through the medium of a conductor 170 shown in a broken line.

The illustrated and described exemplifying embodiment of the invention is highly schematic and conventional details such as a conveyor for the incremental transportation of series of mold sections from the end position 18 of the ram 16 to and through the pouring station 50 have been excluded. It will be understood that the invention is not restricted to the illustrated and described embodiment and can be implemented in any desired manner that lies within the scope of the inventive concept defined in the following Claims.

What is claimed is:

1. In a machine for filling molds with molten metal, a method for controlling pouring position of a pouring machine based on an actual thickness of each mold section, comprising:

fabricating a series of cooperating mold sections, whereby two cooperating mold sections define in respective contact regions a mold cavity, each mold cavity having a recessed pour cup on an upper side thereof arranged for receiving molten metal;

measuring a length of each last fabricated mold section upon fabrication thereof;

moving the series of cooperating mold sections downstream along a predetermined path of travel to a mold pouring station having a pouring machine, the pouring machine being movable longitudinally along the path of travel;

calculating a length difference between a mold section lying immediately upstream of the pouring machine in the pouring station, and the last fabricated mold section in the series;

moving the pouring machine from its previous pouring position through a distance that corresponds to said length difference such that the pouring machine is placed in alignment with an anticipated final position of a pour cup of a next mold to be advanced into the pouring station.

2. The method according to claim 1, further comprising the step of preparing the pouring machine for a pouring operation while the pouring machine is moving towards an anticipated pouring position.

3. The method according to claim 2, further comprising the step of commencing the pouring operation immediately prior to a pour cup reaching its final position.

4. The method according to claim 1, further comprising the steps of sensing an actual final position of a pour cup in the pouring station and finely adjusting a position of the pouring machine in relation to said pour cup.

* * * * *